US009842690B2

(12) United States Patent
Dani

(10) Patent No.: US 9,842,690 B2
(45) Date of Patent: Dec. 12, 2017

(54) APPARATUS AND METHOD FOR BENDING AND WINDING CONDUCTORS TO MAKE SUPERCONDUCTIVE COILS

(71) Applicant: CTE SISTEMI S.r.l., Genoa (IT)

(72) Inventor: Marco Dani, Genoa (IT)

(73) Assignee: CTE SISTEMI S.r.l., Genoa (IT)

( * ) Notice: Subject to any disclaimer, the term of this patent is extended or adjusted under 35 U.S.C. 154(b) by 631 days.

(21) Appl. No.: 14/547,636

(22) Filed: Nov. 19, 2014

(65) Prior Publication Data

US 2015/0135788 A1 May 21, 2015

(30) Foreign Application Priority Data

Nov. 20, 2013 (IT) ..... TO2013A0942

(51) Int. Cl.

| | |
|---|---|
| ***B21D 11/06*** | (2006.01) |
| ***H01F 41/04*** | (2006.01) |
| ***B21D 1/00*** | (2006.01) |
| ***B21D 11/10*** | (2006.01) |

(Continued)

(52) U.S. Cl.

CPC ..... *H01F 41/048* (2013.01); *B21D 1/00* (2013.01); *B21D 7/08* (2013.01); *B21D 11/06* (2013.01); *B21D 11/10* (2013.01); *H01F 6/06* (2013.01); *Y10T 29/49014* (2015.01)

(58) Field of Classification Search

CPC . B21D 5/14; B21D 7/08; B21D 11/06; B21D 11/10; H01F 41/048; H01F 41/06; H01F 41/061; Y10T 29/49014; Y10T 29/49071

See application file for complete search history.

(56) References Cited

U.S. PATENT DOCUMENTS 4,412,438 A * 11/1983 Tjushevsky ..... B21C 47/045 72/11.1

4,918,958 A * 4/1990 Glomb ..... B21C 47/045 72/12.7

(Continued)

OTHER PUBLICATIONS

European Search Report for related European Application No. EP14194112, dated Mar. 11, 2015.

(Continued)

*Primary Examiner* — Edward Tolan

(74) *Attorney, Agent, or Firm* — Meunier Carlin & Curfman LLC

(57) ABSTRACT

The apparatus comprises a first working unit for unwinding a coil of conductor and providing straightened conductor, and a second working unit comprising a bending device arranged to bend the straightened conductor leaving the first working unit and a rotary table on which the bent conductor leaving the bending device is laid, whereby a set of turns is formed to make the superconductive coil. The rotary table is rotatably mounted about a stationary vertical axis. The bending device is mounted so as to be translatable both in a longitudinal direction coinciding with the direction of a longitudinal axis of the straightened conductor that is fed by the first working unit to the bending device and in a transverse direction perpendicular to the longitudinal direction. The first working unit is mounted so as to be translatable, along with the bending device, in the transverse direction only.

8 Claims, 4 Drawing Sheets

(51) Int. Cl.
*H01F 6/06* (2006.01)
*B21D 7/08* (2006.01)

(56) References Cited

U.S. PATENT DOCUMENTS

| | | | | |
|---|---|---|---|---|
| 7,076,979 | B2 * | 7/2006 | Wilhelm | B21D 53/88 72/11.1 |
| 9,468,963 | B2 * | 10/2016 | Fries | B21D 7/024 |
| 2007/0079642 | A1 * | 4/2007 | Bibeau | B21D 11/06 72/307 |

OTHER PUBLICATIONS

Italian Search Report for related Italian Application No. TO2013A000942, dated Jun. 23, 2014.
Fusion for Energy, PF Coil Fabrication Overview, PF Coils Information Meeting, Oct. 15, 2012, Barcelona, Spain, https://industryportal.f4e.europa.eu/Documents/F4E.

* cited by examiner

APPARATUS AND METHOD FOR BENDING AND WINDING CONDUCTORS TO MAKE SUPERCONDUCTIVE COILS

CROSS-REFERENCE TO RELATED APPLICATIONS

This application claims the benefit of Italian Patent Application No. TO2013A000942, filed on Nov. 20, 2013, the disclosure of which is expressly incorporated herein by reference in its entirety.

The present invention relates to an apparatus and a method for bending and winding conductors to make superconductive coils, in particular superconductive coils having turns of circular shape.

A typical apparatus for bending and winding conductors to make superconductive coils basically comprises an unwinding and straightening unit and a bending and winding unit. The unwinding and straightening unit has the function of unwinding a coil with vertical axis, formed by a conductor that is bent with a constant radius and is wound along a cylindrical helical path, providing straightened conductor. To this end, the unwinding and straightening unit drives the coil into rotation about its vertical axis and at the same time straightens the conductor leaving the coil by means of a roller straightening device. The coil is usually unwound continuously and at a constant speed, but the speed may also be changed by the operator or by the control system for various reasons, for example may be reduced during some critical phases of the subsequent winding operation. The bending and winding unit comprises a bending device arranged to bend the straightened conductor and a rotary table on which the bent conductor leaving the bending device is laid, whereby a set of turns is formed to make the superconductive coil. Additional devices may be provided for between the unwinding and straightening unit and the bending and winding unit, which devices are arranged to treat the straightened conductor leaving the unwinding and straightening unit, such as for example one or more fine straightening devices placed downstream of the roller straightening device to further straighten the conductor, a cleaning device and a sandblasting device. The sandblasting device may, however, be placed downstream, instead of upstream, of the bending device. Further devices may be arranged between the bending device and the rotary table to treat the bent conductor leaving the bending device.

Typically, the superconductive coil is not obtained by winding the conductor along a cylindrical helical path with a vertical axis, and hence with the conductor being bent with a constant bending radius, but in the following mode. First, the conductor is bent with a constant radius for a wide angle (for example 330 degrees) and then a joining portion is made, usually referred to as "turn-to-turn transition", which takes the remaining angle (for example 30 degrees) up to a round angle. Such a joining portion and is made so as to end with the conductor arranged again tangentially to the coil axis, but spaced therefrom, inwardly or outwardly, by one turn pitch (which is normally equal to the transverse size of a turn plus the space taken by the insulating layer). This mode allows to obtain a perfectly axially symmetrical flat winding for a wide angle (which is important for ensuring a proper operation of the coil), the non-axially symmetrical path being limited to a relatively narrow angle with respect to the round angle.

The transition from a turn to the adjacent one may be made in the shape of an S by means of a hydraulically-operated die. This operation has to be done manually and with the rotary table stopped, and thus involves an increase in the overall time required to make the coil, as well as the risk of positioning errors. Therefore, although this first solution allows to limit the angle of the transition, it is not currently the preferred one. According to an alternative solution, that is currently the preferred one, the transition from a turn to the next one is obtained by making with the bending device, at the end of the portion having a constant bending radius, a joining portion comprising a section with a smaller bending radius (with respect to the aforesaid constant bending radius) and a section with a larger bending radius (again, with respect to the aforesaid constant bending radius). Making first the section with the smaller bending radius and then the section with the larger bending radius allows to shift from the previously formed turn to a new inner turn, while making the two sections in the reversed order allows to shift from the previously formed turn to a new outer turn. Preferably, the section with the larger bending radius is a straight section, i.e. a section having an infinite bending radius, since making this section as a straight one allows to minimize, all the other conditions being the same, the overall length of the joining portion.

The above-mentioned second solution for making the turn to turn transition requires a wider transition angle, but is quicker and more accurate and does not involve stops of the apparatus.

In order to allow the apparatus to carry out the turn to turn transition using this second solution, it is known to have the bending device stationary, along with the unwinding and straightening unit and with the further devices, if any, upstream of the bending device, and to have the rotary table able to translate in the horizontal plane (in particular both in the forward direction of the straightened conductor, hereinafter referred to as longitudinal direction, or x-direction, and in a direction perpendicular to the x direction, hereinafter referred to as transverse direction, or y-direction), so as to allow the rotary table to change its position in the horizontal plane (hence, both in the x-direction and in the y-direction) when the bending radius is changed at the beginning of the transition phase, and up to the end of that phase. At the end of the transition phase, the rotary table will be in the same position along the x-direction as the initial one, whereas along the y-direction it will be shifted by a distance equal to one turn pitch. Once the transition phase has been completed and until the next transition phase, the rotary table will only be subject to rotary motion.

When superconductive coils of great size, with a diameter in the order of 20 meters or more, have to be produced, it can be very difficult to make the rotary table translate in the horizontal plane. An apparatus that has to produce coils of such sizes and to obtain the turn to turn transition according to the second solution described above is therefore very complicated and expensive.

It is an object of the present invention to provide an apparatus and a method for bending and winding conductors to make superconductive coils that allows to obtain a turn to turn transition according to the second solution discussed above and that are less complicated than the prior art.

This and other objects are fully achieved according to the present invention by virtue of an apparatus and a method for bending and winding conductors to make superconductive coils as defined in the enclosed independent claims 1 and 4, respectively.

Further advantageous features of the invention are set forth in the dependent claims, the content of which is to be regarded as being an integral and integrating part of the following description.

In short, the invention is based on the idea of providing the rotary table with only a rotary movement about its axis, of providing the whole part of the apparatus upstream of the rotary table (i.e. the unwinding and straightening unit, the bending device and the further devices, if any, provided for between the unwinding and straightening unit and the bending device) with a translational movement along the transverse direction, and of providing only the bending device with also a longitudinal translational movement, whereby the turn to turn transition phase is carried out by suitably combining the rotary movement of the rotary table, the translational movement of the part of the apparatus upstream of the rotary table, bending device included, in the transverse direction and the translational movement of the bending device in the longitudinal direction.

Further features and advantages of the invention will result more clearly from the following detailed description, given purely by way of non-limiting example with reference to the appended drawings, where:

Figure 1:
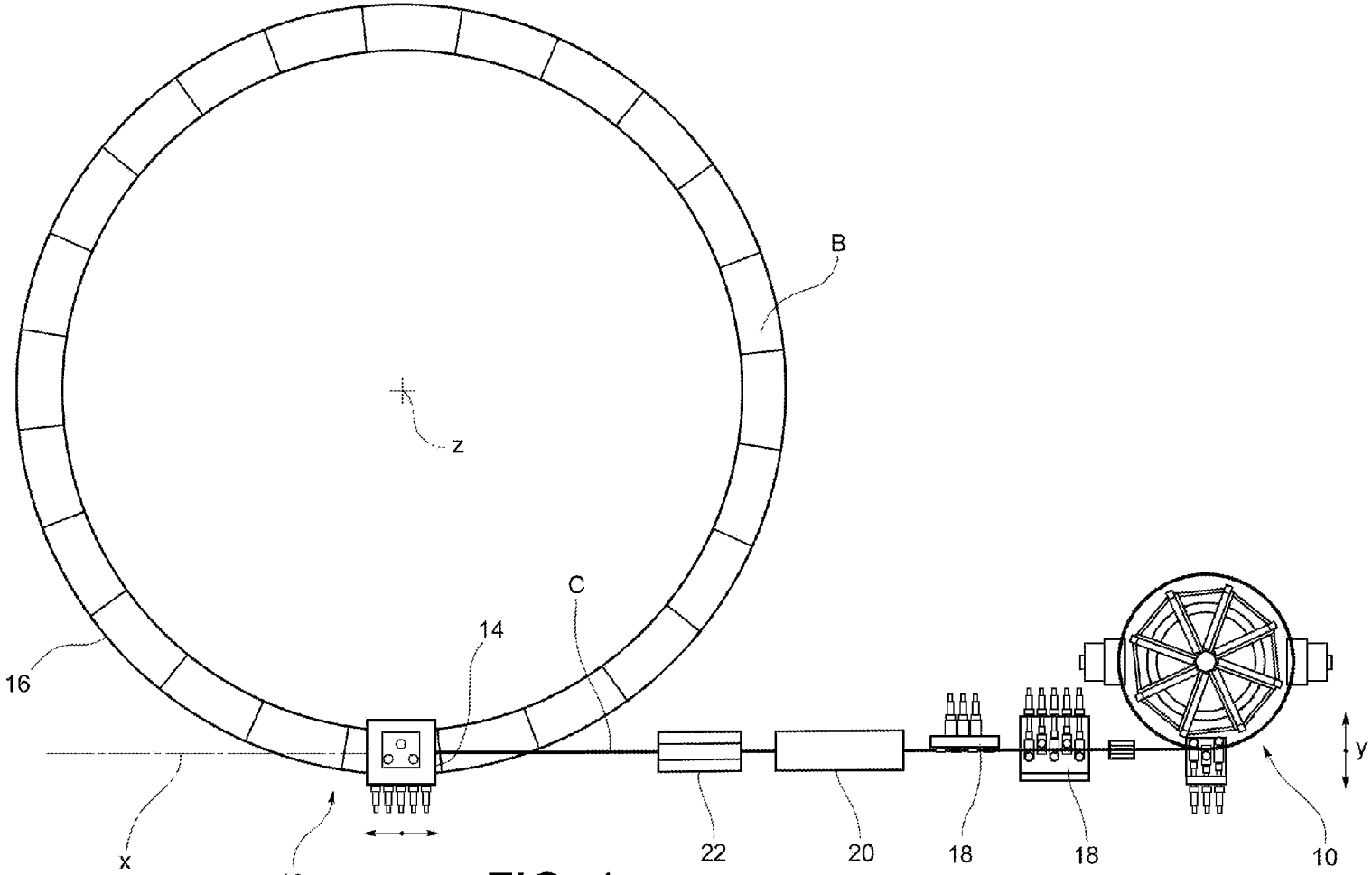
FIG. 1 is a schematic plan view of an apparatus for bending and winding conductors to make superconductive coils according to an embodiment of the present invention.

With reference first to FIG. 1, an apparatus for bending and winding conductors C to make superconductive coils B basically comprises:

- an unwinding and straightening unit 10 for unwinding a coil with vertical axis, which is formed by the conductor C that is bent with a constant radius and wound along a cylindrical helical path, and for providing straightened conductor C,
- a bending and winding unit 12 comprising a bending device 14 arranged to bend the straightened conductor C leaving the unwinding and straightening unit 10 and a rotary table 16 on which the bent conductor C leaving the bending device 14 is laid, whereby a set of turns is formed to make the superconductive coil B, and
- a plurality of intermediate devices that are placed between the unwinding and straightening unit 10 and the bending and winding unit 12 and are arranged to treat the conductor C upstream of the bending and winding unit 12, such as for example one or more fine straightening devices 18 arranged to further straighten the conductor C leaving the unwinding and straightening unit 10, a cleaning device 20 and a sandblasting device 22.

The rotary table 16 is mounted so as to be rotatable about its axis z (vertical axis), as well as translatable along that axis. The rotary table 16 is not, however, movable in the horizontal plane, and therefore the position of its axis z is fixed. The bending device 14 is translatable along a x-direction (hereinafter referred to as longitudinal direction) coinciding with the direction of the longitudinal axis of the straightened conductor C that is fed by the unwinding and straightening unit 10 to the bending device 14. All the part of the apparatus that is placed upstream of the rotary table 16, that is to say the bending device 14, the unwinding and straightening unit 10 and the intermediate devices 18, 20 and 22, if any, interposed between the bending device 14 and the unwinding and straightening unit 10, is translatable along a y-direction (hereinafter referred to as transverse direction) that is oriented horizontally and perpendicular to the longitudinal direction.

Figure 2:
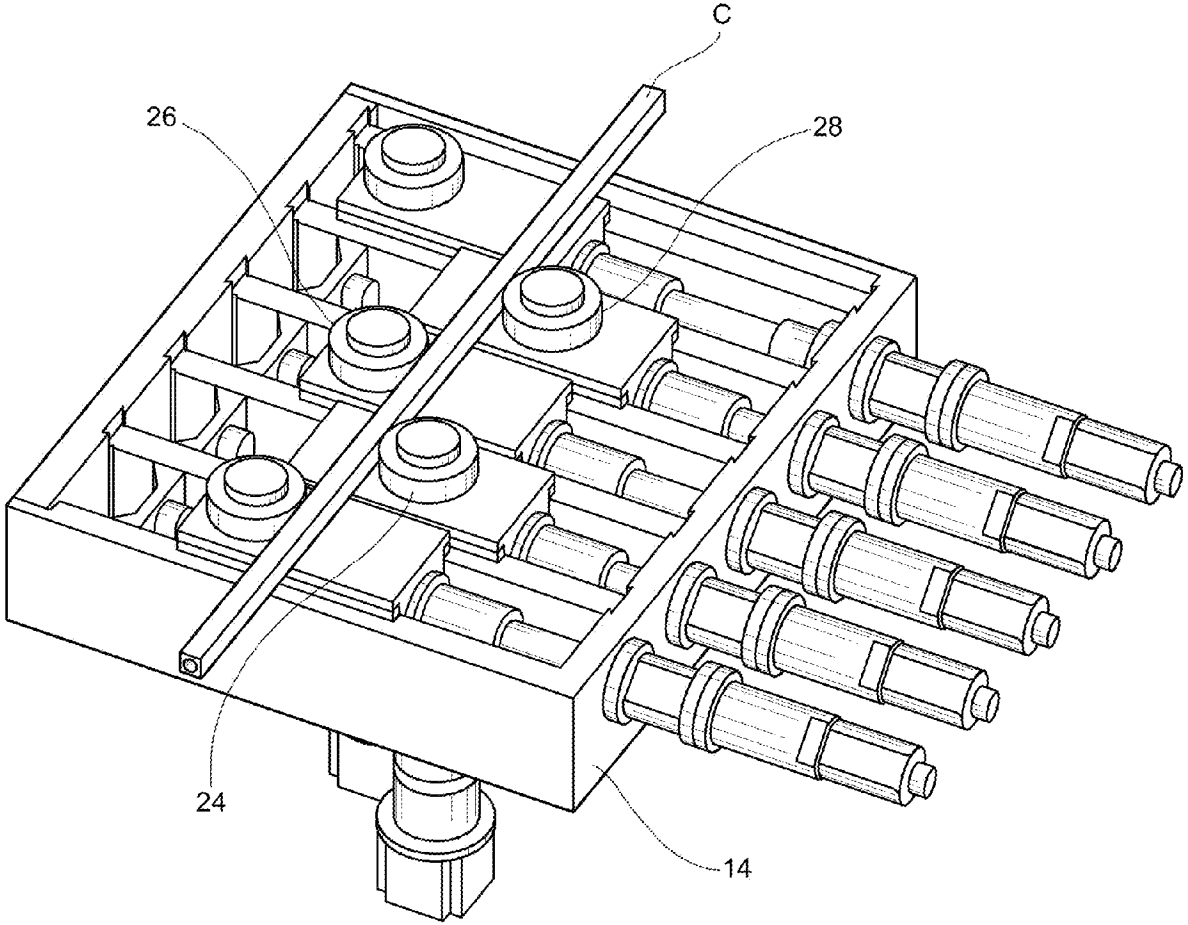
FIG. 2 is a perspective view of the bending device of the apparatus of FIG. 1.

FIG. 2 shows a typical example of a bending device 14 that can be used in an apparatus for bending and winding conductors to make superconductive coils, and more specifically a so called three-roller bending device, that is to say a bending device which comprises three rollers 24, 26 and 28, usually referred to as first roller, middle roller and bending roller, respectively, which are placed in such a manner that the conductor C that is being fed through the bending device 14 passes between the first roller 24 and the bending roller 28 on one side and the middle roller 26 on the opposite side. In the embodiment shown in FIG. 2, the bending device 14 comprises additional rollers 30 and 32, which are placed upstream and downstream of the three above-mentioned rollers, respectively, but these additional rollers might also be omitted. Moreover, the bending device 14 might also have a configuration different from the one shown herein.

The way the turn to turn transition phase, and more specifically the transition from an outer turn $S_e$ to an inner turn $S_i$ of the coil B, is carried out in an apparatus according to the present invention will be described now with reference to FIGS. 3*a* to 3*g*, with regard to the case where the joining portion between the two turns comprises a first curved section having a smaller bending radius and a second straight section.

Figures 3A, 3B, 3C, 3D:
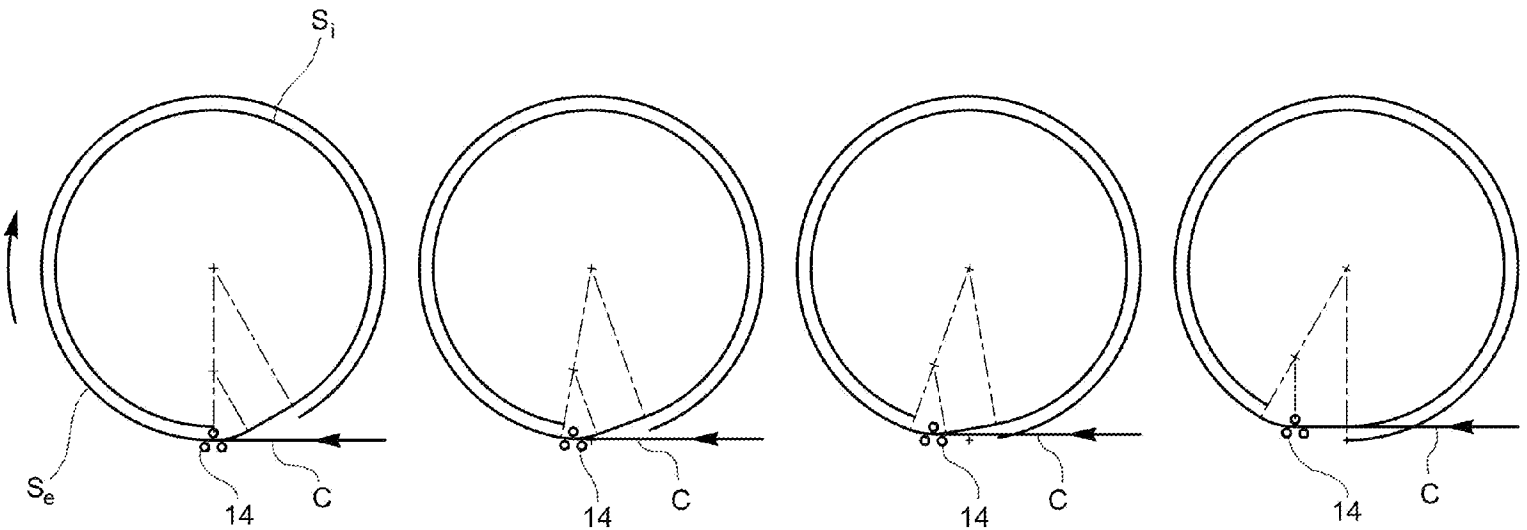
FIGS. 3*a* to 3*g* are schematic views showing in sequence how the turn to turn transition phase is carried out with an apparatus and a method according to the invention.

FIG. 3*a* shows the condition at the end of the main constant-radius turn portion. During the entire process of making this turn portion, the bending device 14 is not moved along the x-direction, the part of the apparatus that is placed upstream of the rotary table 16 (bending device 14 included) is not moved along the y-direction and the rotary table 16 is set into rotation about the axis z (for example at a constant speed), with the conductor C being forwarded along the x-direction (for example at a constant speed as well), from the unwinding and straightening unit 10 to the bending device 14.

During the turn to turn transition phase, the translational movement along the y-direction of the part of the apparatus that is placed upstream of the rotary table 16 and the translational movement along the x-direction of the bending device 14, as well as the rotary movement of the rotary table 16 about its axis z, are controlled as explained below.

As far as the translational movement of the bending device 14 along the x-direction is concerned, the law of movement that is preferably applied is the following one:

$$\Delta x(a)=R\cdot\sin\alpha,$$

wherein $\alpha$ is the current angular position of the rotary table 16 (hence of the coil B that is being formed on the rotary table 16), measured from the starting point of the transition, and R is the distance between the axis of rotation z of the rotary table 16 (i.e. of the coil B) and the centre of curvature of the first section (curved section) of the transition, that is to say the difference between the radius of the turn $S_e$ that has already been formed and the radius of the first section of the transition.

As soon as the constant-radius turn portion has been completed, the bending device starts to move in the x-direction (see FIGS. 3*b* and 3*c*), preferably according to the above-mentioned law of movement, so as to meet the requirement of tangency of the longitudinal axis of the conductor C with the arc of the transition in the current point. During the process of making the curved portion of the transition, the position of the rollers of the bending device 14 is adjusted to define the correct radius of the curved portion of the transition.

Moreover, during the process of making the curved portion of the transition, the part of the apparatus that is placed upstream of the rotary table 16 is caused to move along the y-direction towards the radial position—with respect to the rotary table 16—corresponding to the inner turn $S_i$.

FIG. 3*d* shows the end point of the curved portion of the transition. In this condition, the bending device 14 has reached its maximum forward position along the x-direction, while the part of the apparatus that is placed upstream of the rotary table 16 has reached a position along the y-direction corresponding to the inner turn $S_i$, as it has moved along this direction by one turn pitch. In the condition illustrated in FIG. 3*d*, both the rotation of the rotary table 16 and the forward movement of the conductor C have been stopped to allow the bending device 14 to move back to the correct position along the x-direction to be able to start the bending of the main constant-radius portion, which will have a radius equal to that of the previous turn $S_e$ minus one turn pitch (see FIG. 3*f*).

Figure 3G:
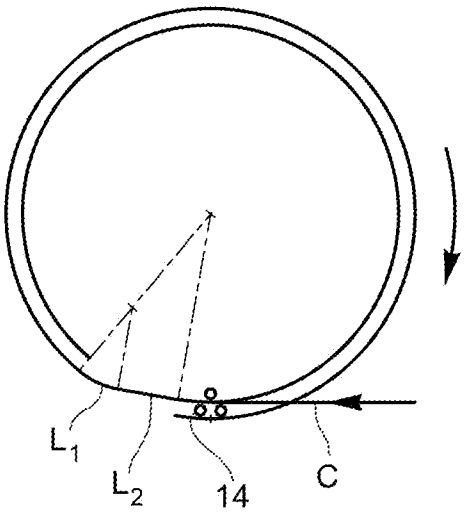

In order to allow the bending device 14 to move along the x-direction in the opposite direction to that of the previous movement, it is necessary first to adapt the position of the rollers of the bending device 14, in particular of the bending roller 28, to the straightened portion of the conductor C. This phase is shown in FIG. 3*e*.

Figure 3F:
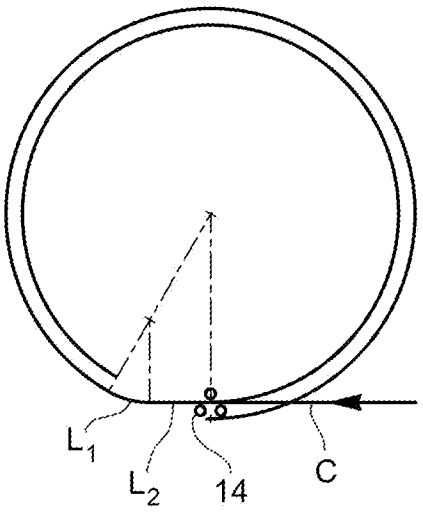
Figure 3E:
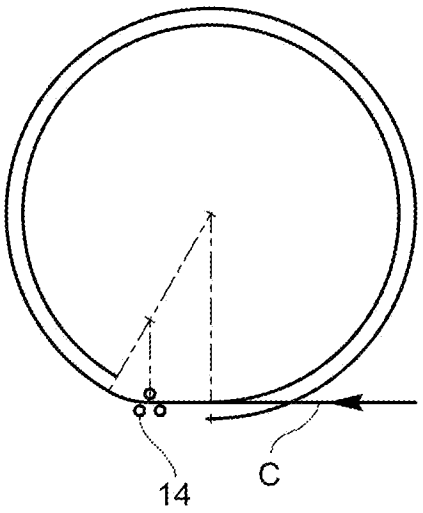

FIG. 3*f* refers to the condition where the transition portion has been completely made. In this figure the curved section of the transition portion is indicated $L_1$, while the straight section is indicated $L_2$.

FIG. 3*g* shows a first constant-radius portion of the inner turn $S_i$ that has already been made. The bending roller 28 has reached—as from the end of the phase shown in FIG. 3*e*—the position suitable for forming the inner turn $S_i$. Throughout the constant-radius portion of the inner turn $S_i$ the same considerations apply as those already set forth with reference to FIG. 3*a*.

With regard to the movement of the rollers of the bending device 14 in the y-direction, i.e. the movement that produces and controls the bending of the conductor C, it is normally adjusted depending on the forward movement of the conductor C through the bending device itself, and more specifically depending on the movement of the conductor leaving the bending device. In this case, this will be a relative forward movement, i.e. a forward movement of the conductor C leaving the bending device 14 relative to the bending device itself. Indicating with Δt the current arc of the transition and with r the radius of the transition, the following equation applies:

$$\Delta t = \alpha \cdot r.$$

It is to be taken into account that the above-mentioned equations refer only to "after bending" parameters, such as α and Δt, while the forward movement of the conductor relative to the bending device is to be intended as "leaving the bending device". The reason is that in this way the equations are not affected by approximation errors due to changes in length of the conductor inside the bending device. However, it is not in practice easy to measure the forward movement of the conductor relative to the bending device after bending, particularly in case of a transition involving radius changes. Therefore, it is admissible—as far as the transition is concerned—to use in practice the forward movement before bending, as this is easy to measure with an appropriate encoder system, thereby overlooking the small error connected to the length change through a relatively short length.

In addition to providing a structurally less complicated solution for making the turn to turn transition, which is particularly advantageous in case of large-size coils, the present invention offers the advantage of allowing to make the position corrections required to compensate for the errors due to the elasticity of the portion of conductor comprised between the rollers of the bending device. Typically, the centre of curvature of the conductor leaving the bending device does not lie in the middle transverse plane of the bending device itself, i.e. in the plane that is perpendicular to the longitudinal of the conductor entering the bending device and passes through the axis of the middle roller of the bending device. This is due to the elastic component of the portion of conductor comprised between the rollers of the bending device. The elastic component is then released when the conductor leaves the bending device. Generally, the position of the centre of curvature of the conductor leaving the bending device is significantly spaced from said middle transverse plane, both in the longitudinal direction x and in the transverse direction y. This effect must be compensated, in that the elastic stresses in the bent portion of the conductor comprised between the bending device and the rotary table must be cancelled as much as possible, since these stresses may cause deformations of the conductor which are, of course, undesirable. The required corrections can be made, with an apparatus according to the invention, by suitably moving the bending device along the x- and y-directions and/or by suitably moving the part of the apparatus upstream of the bending device along the y-direction.

Naturally, the principle of the invention remaining unchanged, the embodiments and the constructional details may be greatly modified with respect to those described and illustrated purely by way of a non-limiting example, without thereby departing from the scope of protection as defined in the appended claims.

The invention claimed is:

1. An apparatus for bending and winding conductors to make superconductive coils, the apparatus comprising:

a first working unit for unwinding a coil of conductor and providing straightened conductor, and a second working unit comprising a bending device arranged to bend the straightened conductor leaving the first working unit and a rotary table on which the curved conductor leaving the bending device is laid, whereby a set of turns is formed to make the superconductive coil;

wherein the rotary table is rotatably mounted about a stationary vertical axis, and wherein the bending device is mounted so as to be translatable both in a longitudinal direction coinciding with the direction of a longitudinal axis of the straightened conductor that is fed by the first working unit to the bending device and in a transverse direction perpendicular to the longitudinal direction, and wherein the first working unit is mounted so as to be translatable, along with the bending device, in the transverse direction only.

2. An apparatus according to claim 1, further comprising, between the first working unit and the second working unit, a plurality of intermediate devices arranged to treat the straightened conductor upstream of the second working unit, said intermediate devices being translatable, along with the first working unit and with the bending device, in the transverse direction only.

3. An apparatus according to claim 2, wherein said intermediate devices comprise one or more fine straightening devices arranged to further straighten the straightened conductor leaving the first working unit.

4. An apparatus according to claim 2, wherein said intermediate devices comprise a cleaning device.

5. An apparatus according to claim 2, wherein said intermediate devices comprise a sandblasting device.

6. A method for bending and winding conductors to make superconductive coils, comprising:

unwinding a coil of conductor, providing straightened conductor, in a first working unit;

bending the straightened conductor by means of a bending device; and laying the bent conductor on a rotary table, that is rotatable about a stationary vertical axis, whereby a set of turns is formed to make the superconductive coil;

wherein the bending the straightened conductor by means of a bending device and the laying the bent conductor on a rotary table are carried out so as to form each time a turn having a main portion with a constant bending radius and a transition portion connecting the main portion of this turn with the main portion of a following turn, said transition portion being formed so as to end with the conductor placed tangentially to the axis of the coil that is being made, but spaced by a given distance, inwardly or outwardly, from the first turn, and comprising a first section having a bending radius smaller than the bending radius of the main portion of the first turn and a second section having a bending radius larger than the bending radius of the main portion of the first turn, and wherein the transition portion is obtained by controlling the rotational movement of the rotary table about the vertical axis, the translational movement of the bending device in a longitudinal direction coinciding with a longitudinal axis of the straightened conductor and the translational movement of the bending device, along with the first working unit, in a transverse direction perpendicular to the longitudinal direction.

7. A method according to claim 6, wherein said first section is obtained by causing the rotary table to rotate about the vertical axis and by causing at the same time both the bending device to translate in the longitudinal direction and the bending device, along with the first working unit, to translate in the transverse direction.

8. A method according to claim 6, wherein said second section is a straight section and is obtained, with the rotary table stopped, by causing the bending device to translate in the longitudinal direction.

* * * * *